United States Patent [19]

Houseknecht

[11] Patent Number: 4,744,462

[45] Date of Patent: May 17, 1988

[54] ESCUTCHEON DEVICE FOR VENDING MACHINE

[76] Inventor: Thomas Houseknecht, Five Madison Ave., Batavia, N.Y. 14020

[21] Appl. No.: 61,155

[22] Filed: Jun. 10, 1987

[51] Int. Cl.[4] ..... B65D 79/00

[52] U.S. Cl. ..... 206/223

[58] Field of Search ..... 206/223, 549, 582, 231

[56] References Cited

U.S. PATENT DOCUMENTS

| | | | |
|---|---|---|---|
| 4,157,756 | 6/1979 | Stratis | 206/223 |
| 4,510,353 | 4/1985 | Nemitz | 206/223 |
| 4,690,413 | 9/1987 | Adkins | 206/223 |

*Primary Examiner*—Joseph Man-Fu Moy

[57] ABSTRACT

An escutcheon device for use in vending machines that allows an older machine to accommodate a paper money validator without replacing the machine and allows a newer machine to accept a paper money validator with larger stacking capacity.

5 Claims, 7 Drawing Sheets

ESCUTCHEON DEVICE FOR VENDING MACHINE

This invention relates to an escutcheon kit and more particularly to an escutcheon kit for use in vending machines and the like that allows the machine to be adapted to accept a paper money validator and/or to accept a paper money validator with larger stacking capacity.

Vending machines have been a fixture in society for a number of years. Items typically dispensed from a vending machine include soda, gum, candy, snacks and a variety of personal items. With inflation, however, consumer prices have increased. Further, as a matter of convenience, fewer people carry change. As a result, newer models of vending machines have included paper money validators in addition to the traditional coin validators. This allows the consumer to use a one, two or five dollar bill to purchase a product without change. It also increases the range of products that may be purchased through a vending machine.

Paper money validators currently are manufactured by a number of companies, including National Vendors, Mars Electronics, Rowe, Maka and Ardac. These units and others all have similar features including a slot to accept the money, electronic means to validate the money inserted, communication means with a coin changer and a holder (or stacker) to stack the paper money inserted until removal by the vendor. Taken together these features require a relatively large space for housing the unit.

Additional size limitations exist on both older and newer machines if one seeks to expand the size of the stacker. In a vending machine with a capacity of 600 cans, a typical bill stacker will accommodate only 110 bills. This requires frequent changes. Stackers capable of accepting 400 bills provide an alternative, but the extra area taken by the enlarged stacker cannot be accommodated even on new machines.

Finally, as a security measure, the unit preferably should be housed within the vending machine. Many existing vending machines, however, are not capable of accepting such units without substantial modification. As a result, a vendor wishing to have a paper money validator unit on its machines will have to either purchase a new machine designed to accept a validator or substantially modify the existing machine typically mounting the unit outside the machine and providing a separate lock and key mechanism for access thereto. Thus, existing devices are expensive and provide for poor security. The present invention comprises an escutcheon kit which expands the area within a vending machine to allow the machine to be modified at very low cost while retaining the security provided by the machine itself.

Briefly described, the escutcheon kit comprises a housing the dimensions of which are sufficient to accommodate at least a portion of a paper money validator. The housing is mounted from the interior of the vending machine after a hole has been cut through a portion of the machine. The housing has an opening that provides access to a bill insertion slot on the validator. The kit further comprises a template mounted from the exterior of the machine with studs protruding to the inside of the vending machine to hold the housing in place. Securing means are included in the housing to hold the validator in place.

An advantage of this kit is that it allows older vending machines to be converted at low cost.

A feature of this kit is its ability to accept a majority of validators currently marketed.

Another feature of this kit is its ability to modify newer vending machines to accept a validator with larger stacking capacity.

A further advantage of this kit is that the validator is attached securely to the machine with access to the validator only by opening the machine.

Other features and advantages of this invention, including the best mode currently known for the practice thereof, will be apparent from the following detailed description which makes reference to the following figures, in which:

FIGS. 1*a* and *b* are front and rear views respectively of the outer door of a typical soda vending machine;

FIG. 2 is a front view of the inner door of the machine shown in FIG. 1;

FIGS. 3*a* and *b* are side views of the housing and template respectively as configured for a soda machine;

Figure 6A:
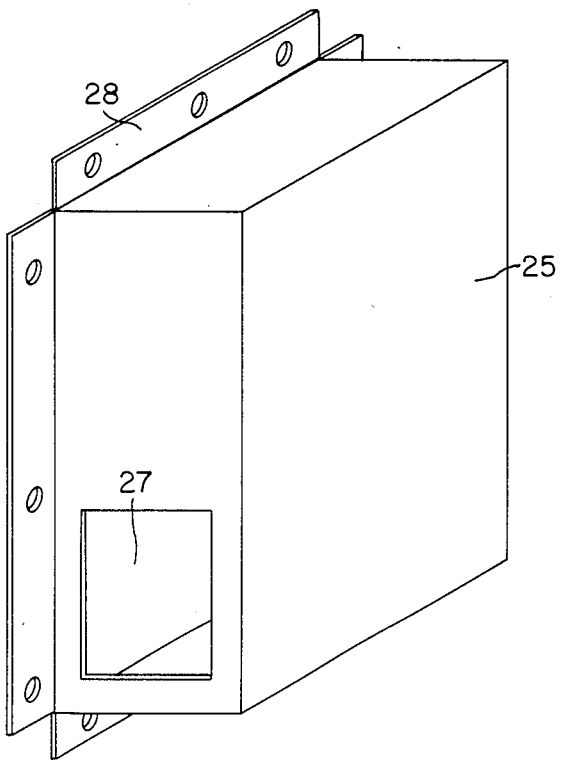
Figure 6B:
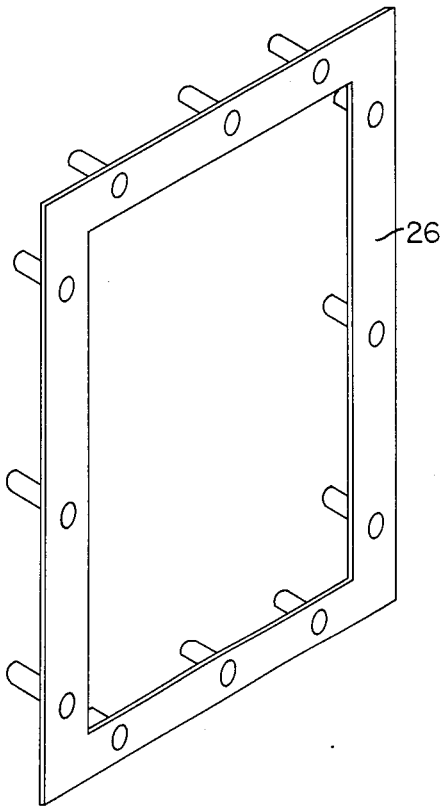
Figure 7:
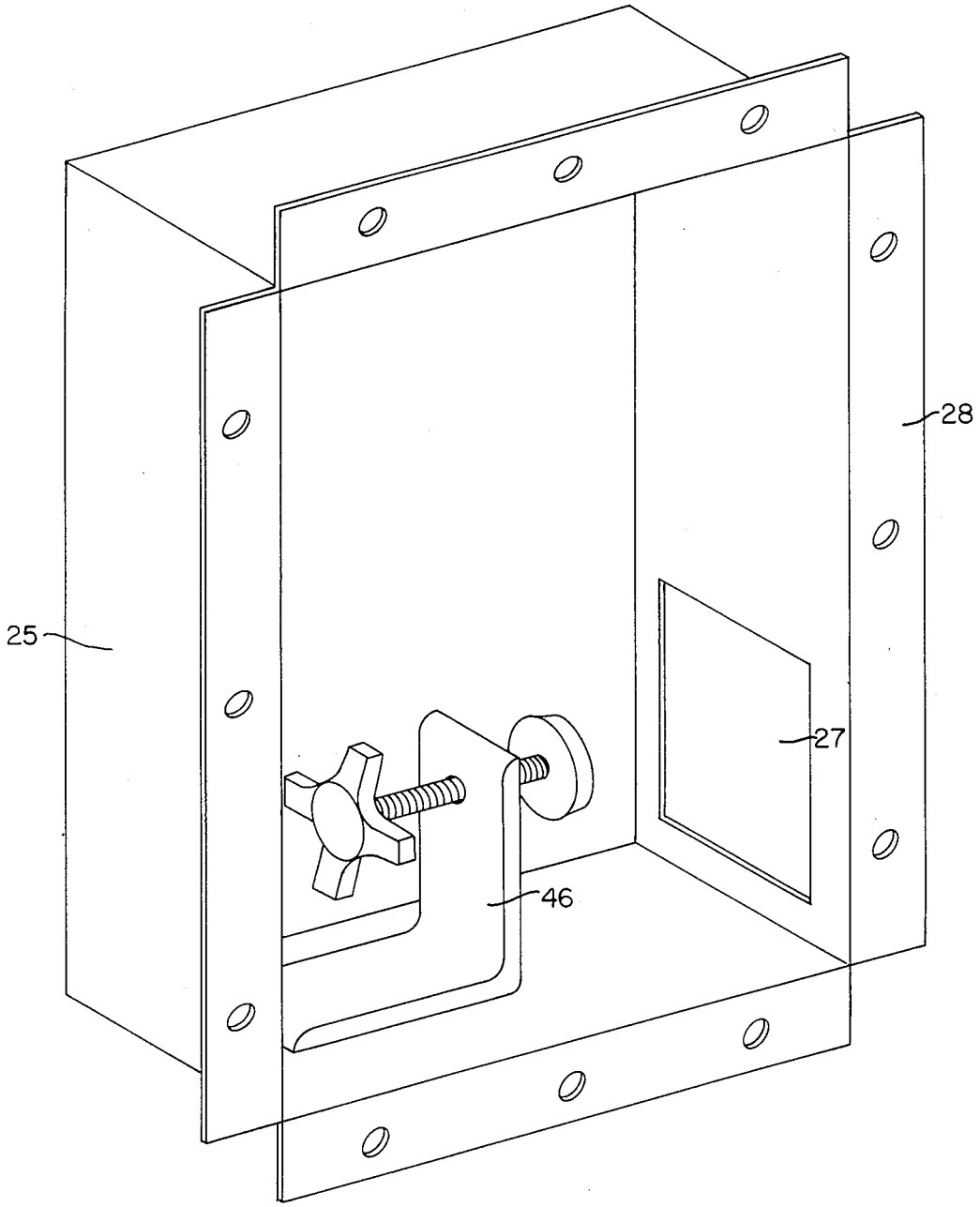

FIGS. 6*a* and *b* are side views of the housing and template respectively as configured for a cigarette vending machine;

FIG. 7 is a rear view of the housing shown in FIG. 6*a*; and

Figure 8:
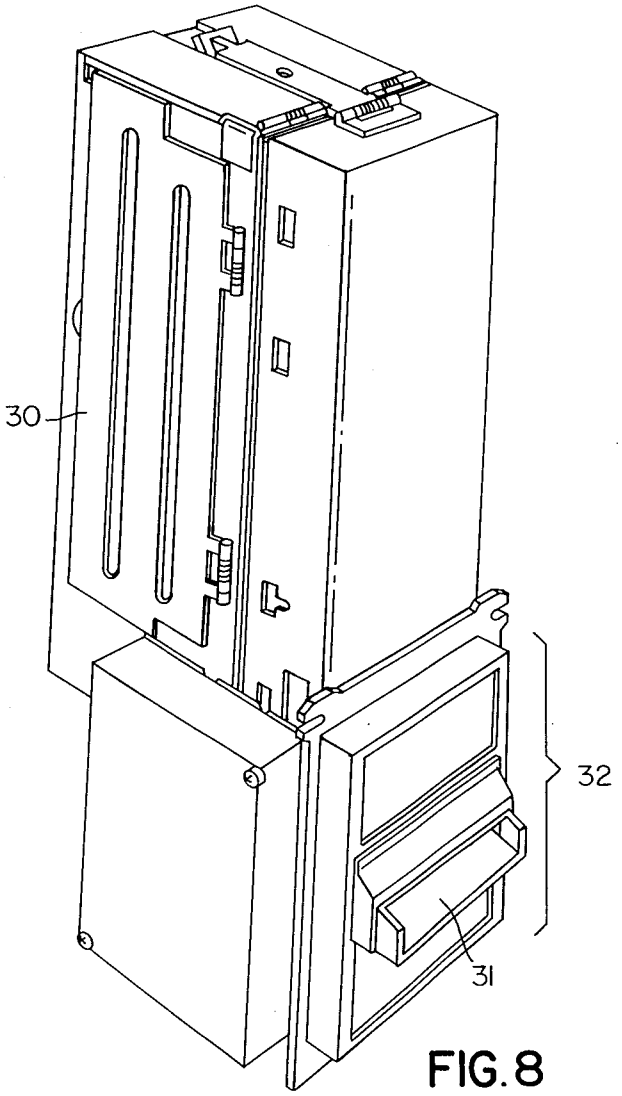

FIG. 8 is a partial side view of a typical paper money validator.

Figure 1B:
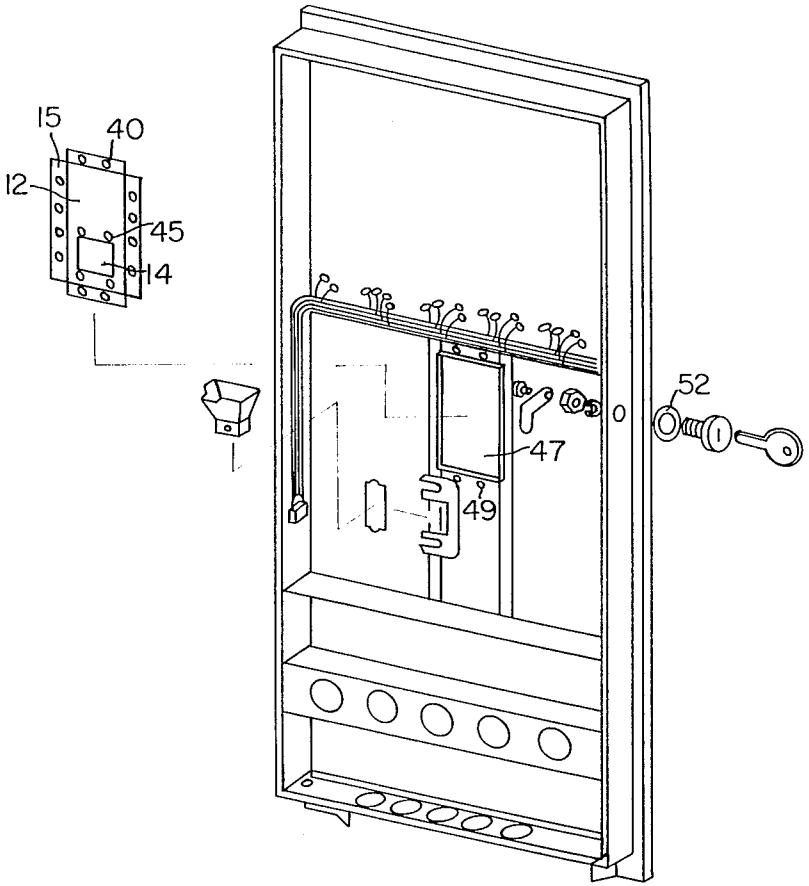
Figure 1A:
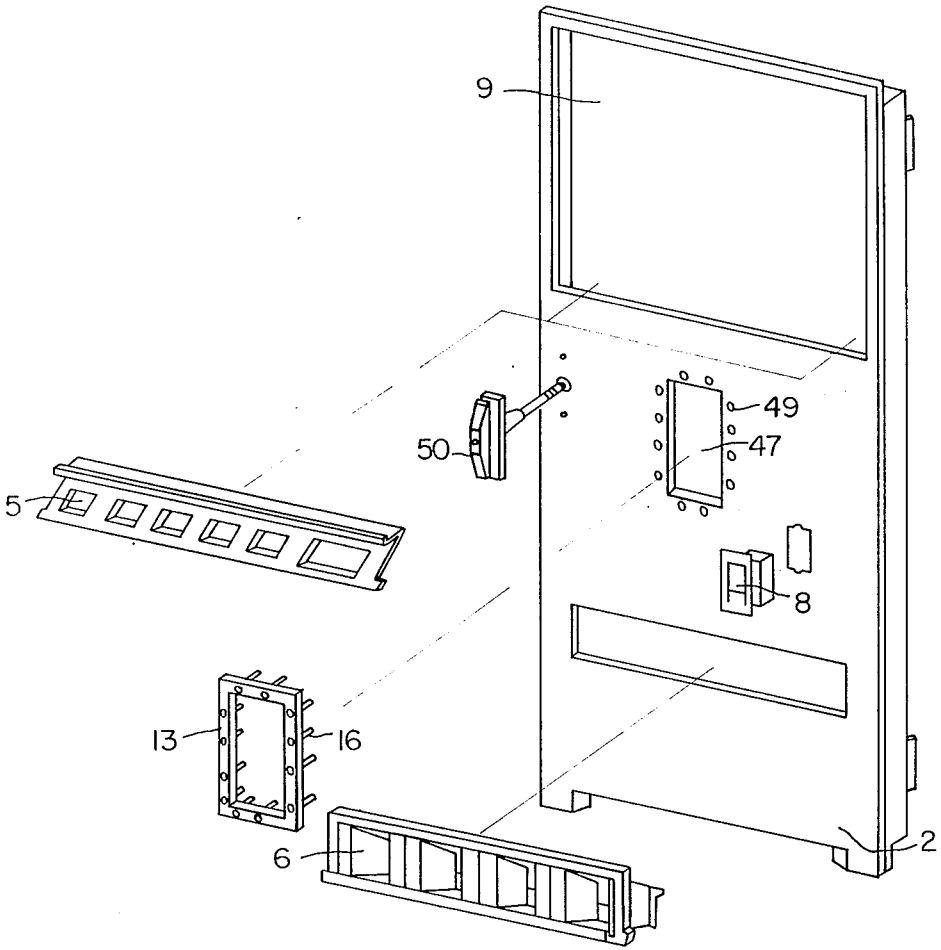
Figure 4:
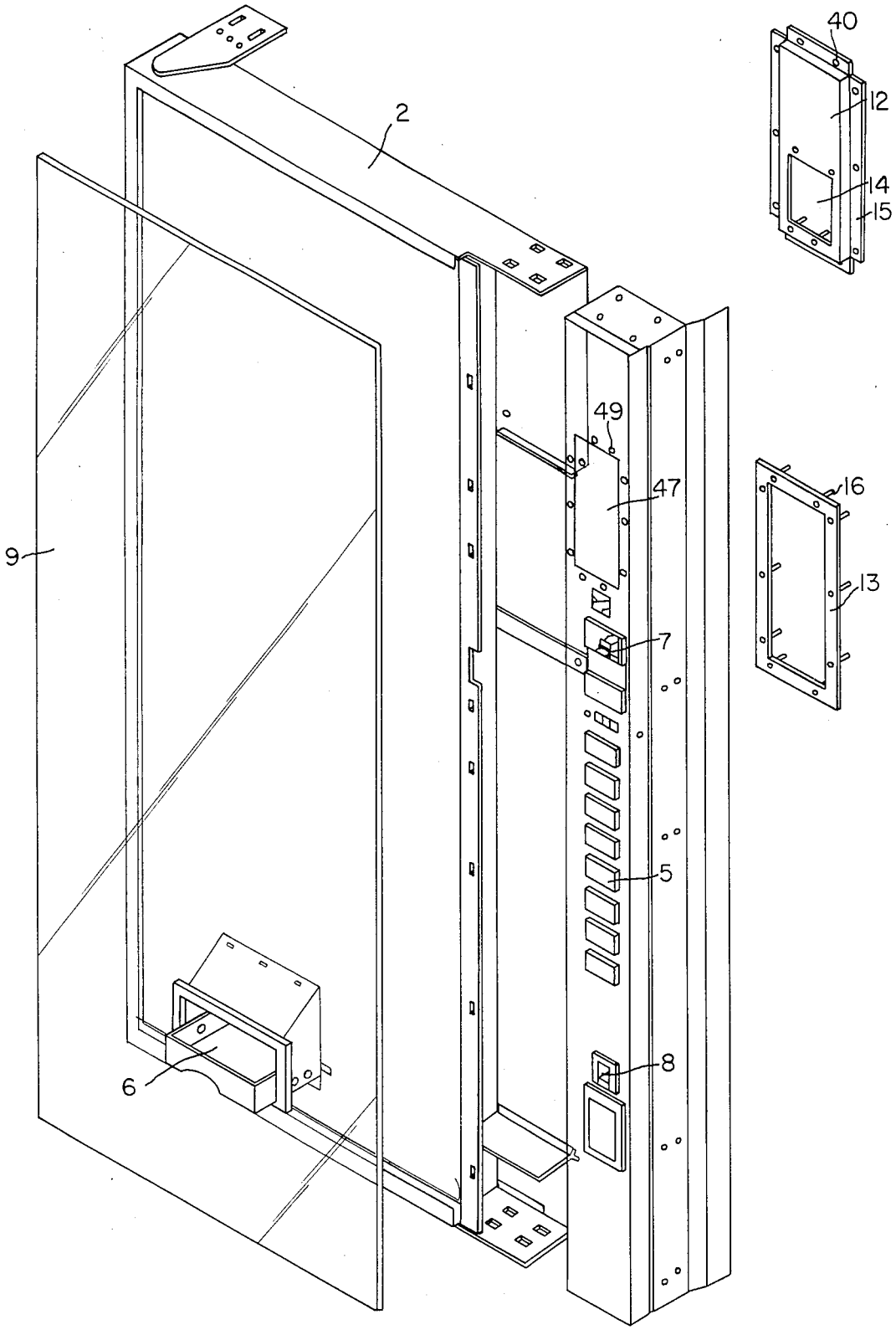
FIG. 4 is a front view of the outer door of an alternate type soda vending machine and showing the kit as configured in FIG. 3.

Referring to FIGS. 1 and 4, a typical vending machine for dispensing soda or other canned products requiring refrigeration. The machine comprises an outer door 2, an inner door 3, a storage area (not shown) and a refrigeration unit (not shown). On the face of the outer door, there are means 5 to push to select a product. The selection means 5 communicate with other means (not shown) which cause the release of a product in the storage area to a dispensing area 6. The face of the outer door also has a slot 7 for the acceptance of coins and a coin return slot 8. Acceptance slot 7 communicates with a coin validator 10, change storage bank 1 and a coin storage box 11. See FIG. 2. The face may further comprise advertising or product panels 9. See FIGS. 1*a* and 4. Outer door 2 typically is not insulated. It has a locking means 50. In normal operation, unlocking means 50 causes both doors 2,3 to open allowing access to the storage area. The inner door 3 may be opened separately by unlocking means 52.

Figure 2:
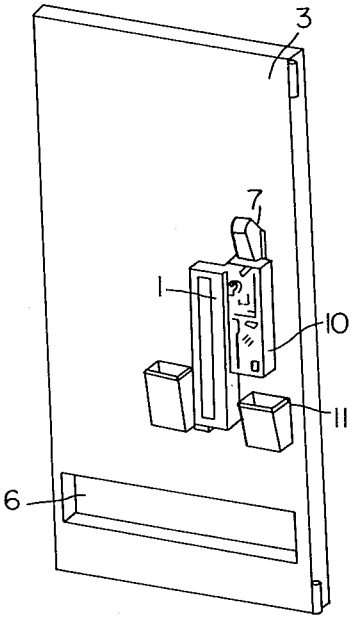

Referring to FIG. 2, inner door 3 typically comprises an insulated panel. The coin validator 10, change storage 1 and coin storage box 11 typically are mounted to the outside of inner door 3, and are designed to fit between the outer and inner doors when closed in their normal operating position. The distance between the inside of the outer door and the outside of inner door typically is less than 4 inches in older models and less than 5 inches in newer models.

Referring to FIG. 8, the typical bill validator comprises a bill insertion slot 31 to accept paper money, means communicating with the coin return (not shown) and a bill stacker 30. In addition, the validator has a raised face 32 which protrudes from the validator and which contains the bill insertion slot 31. Including stacker 30, the typical bill validator has approximate dimensions of 11.5 inches high, 5 inches wide and 4.5 inches deep for stackers holding 110 bills and 5.5 inches deep for stackers holding 400 bills. Thus, it is readily apparent that the bill validator will not fit between outer door 2 and inner door 3.

Figure 3A:
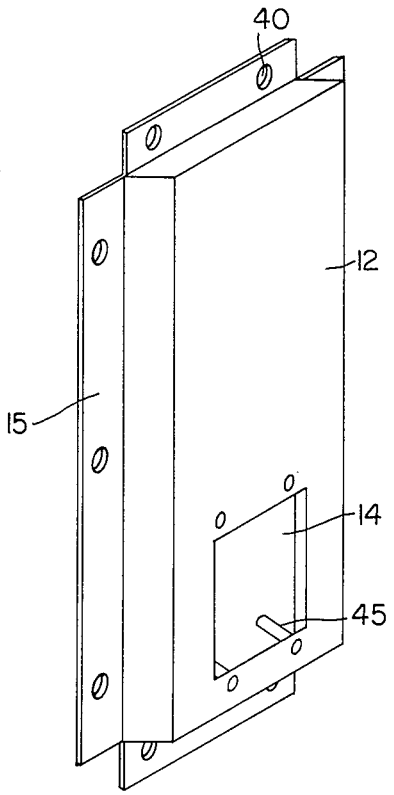
Figure 3B:
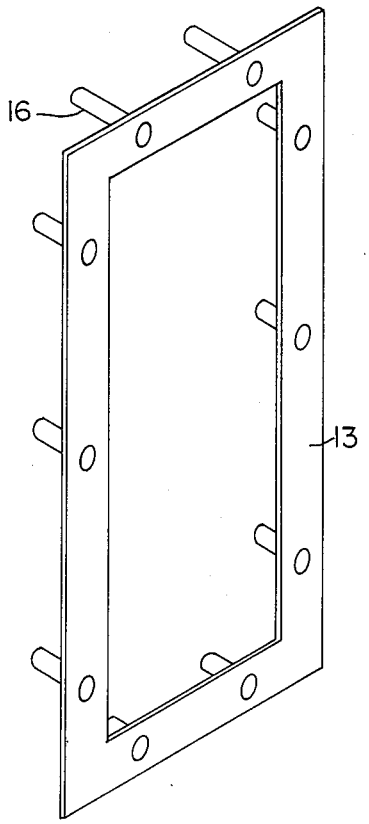

Referring to FIG. 3, an escutcheon kit is comprised of a housing shown generally as 12, a template shown generally as 13 and an opening 14 in said housing. The dimensions of the housing must provide sufficient depth to allow the bill validator to fit between the outer 2 and inner 3 doors. In the preferred embodiment, the depth of the housing 12 is approximately 1 inch. The height and width of housing 12 also should be sufficient to accommodate the bill validator. In the preferred embodiment, the height is approximately 11.75 inches and the width is approximately 4.50 inches. While the housing 12 is shown as being generally rectangular, other variations in configuration may be had so long as they are sufficient to accept at least a portion of the validator.

The opening 14 should be of sufficient size to allow the raised face 32 of the bill validator to protrude through. In the preferred embodiment, the dimensions of the opening are 3.5 inches wide by 4.25 inches high.

The housing further comprises securing means 45 which secure the validator to the kit. These securing means may be bolts or clips, and should be designed to firmly hold the validator in place while allowing removal of the validator for servicing.

Attached to said housing 12 and forming an integral part thereof is a border 15 which extends beyond the outer dimension of the housing forming a lip. The dimensions of the border should be sufficient to hold the housing securely against the outer door. The border 15 has a plurality of holes 40 through which fastening means on the template 13 are inserted. The housing 12 and border 15 may be formed from a single piece that is stamped and folded by means known to those skilled in the art.

The template 13 is designed to fit over and mate with the housing 12. The template 13 has a plurality of fastening means 16, such as studs or bolts and the like, which, when opposed to the housing, mate with and protrude through the holes 40 in the border 15.

Both the template and housing/border should be made of a strong, unbreakable material such as steel. The material should be sufficient to resist forced entry into the machine.

To install the kit, an opening 47 sufficient to accept the housing 12 is cut in the outer door 2 in an otherwise unobstructed area. See FIGS. 1 and 4. This area should be of sufficient structual integrity to withstand forced entry but that is not required. The area also should be near the coin validator but that is not required. Once the opening is made, the housing 12 is mounted through the opening from the inside of the outer door 2. Holes 49 matching those in the border 15 of the housing then may be cut through the outer door 2. The template 13 then is attached from the outside of the outer door 2 with the fastening means 16 going through the outer door 2 and border 15. The fastening means 16 may be secured from the inside of outer door 2 by nuts or other similar means. In this way, the kit is affixed to the outer door 2 as an integral unit that requires the outer door to be opened to allow access to the validator.

While soda vending machines with limited space between the double doors provide one type of problem, other vending machines, such as cigarette machines, pose a different problem. Here, the products to be sold are typically mounted behind a single glass door or enclosure 20. See FIG. 5. In this type machine there is no place to mount the kit on the door. As an alternative embodiment, therefore, the escutcheon kit is expanded to accommodate all or a majority of the validator unit but is mounted on the side of the machine.

Figure 5:
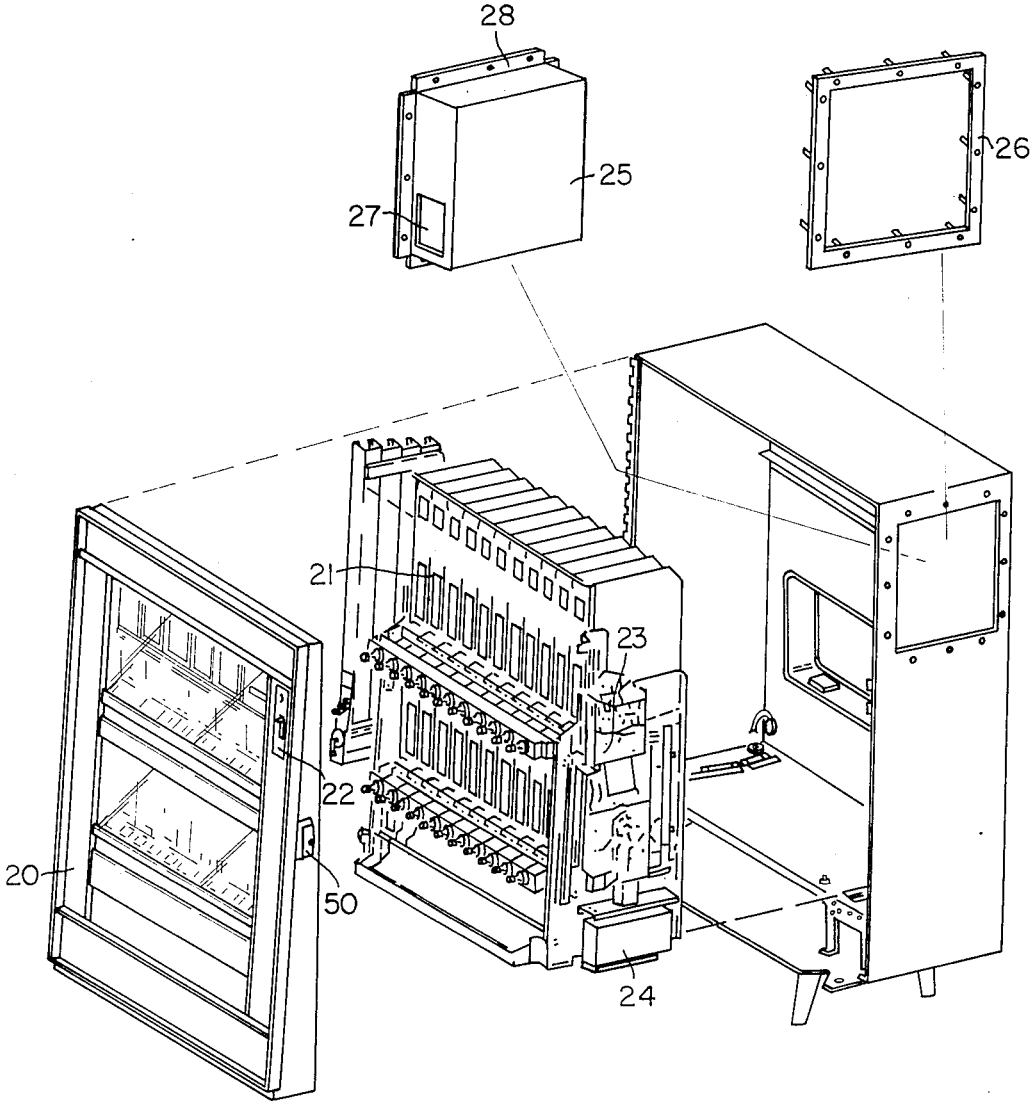
FIG. 5 is an exploded view of a typical cigarette vending machine, and including the kit as configured in FIG. 6.

Referring to FIG. 5, the door 20 opens directly to a storage area 21. A coin acceptance slot 22 is mounted to the side of the door 20. Behind said slot 22 is a coin validator 23 and a coin storage box 24. In this type configuration, a side-mount kit comprises the most viable means for modifying the machine to accept a bill validator.

Referring to FIGS. 6*a* and *b*, the kit again comprises a housing 25, a template 26 and an opening 27 in said housing. In this instance, the housing 25 should be of sufficient dimension to accommodate a greater portion, if not all, of the bill validator. In the preferred embodiment, the dimensions of the housing 22 are 13.25 inches high, 4.5 inches wide and 8.5 inches deep and will accept the entirety of the bill validator.

Like the previously described embodiment, the housing 25 has an integral border 28 of similar design, function and manufacture as described previously. Similarly, the template 23 has fastening means to be inserted through holes 29 in said border and in the side of the machine. The housing and template are mounted through the machine as previously described.

Securing means 45 within the housing 22 may be as previously described. Alternatively, a thumbscrew device 46 may be used to attach the validator securely to the housing. A large thumbscrew provides easy means to remove the validator.

Variations and modifications in the above-described invention may suggest themselves to one skilled in the art. Accordingly, the description of the invention should not be taken in a limiting sense.

I claim:

1. An escutcheon kit for use in adding a paper money validator to an existing vending machine lacking said validator which comprises a housing of dimensions sufficient to accommodate at least a portion of said validator, having securing means within said housing to secure the validator to said housing, and having a border forming a lip around one edge of said housing of dimensions sufficient to securely hold said housing to said vending machine, a template of dimensions similar to said border and having fastening means to secure said housing when said border and said template are opposed, wherein said template is opposed to said housing from the outside of the vending machine, and an opening within said housing of dimensions sufficient to allow access to said validator.

2. The kit according to claim 1 wherein said housing is of dimensions sufficient to contain the entire validator.

3. The kit according to claim 2 wherein said securing means comprises a large thumbscrew.

4. The kit according to claim 1 wherein said fastening means comprise bolts.

5. The kit according to claim 1 wherein said housing is rectangular.

* * * * *